United States Patent [19]

Dougherty

[11] 3,988,899

[45] Nov. 2, 1976

[54] PILE JOINER FOR CONNECTING THE ENDS OF CONCRETE PILES AND ITS MEMBERS

[75] Inventor: John J. Dougherty, Cedar Grove, N.J.

[73] Assignee: APF Corporation, Clifton, N.J.

[22] Filed: July 1, 1975

[21] Appl. No.: 592,189

[52] U.S. Cl. ..... 61/53; 61/56; 403/379

[51] Int. Cl.[2] ..... E02D 5/30; B25G 3/00

[58] Field of Search ..... 61/53, 56, 56.5; 403/379, 378

[56] References Cited

FOREIGN PATENTS OR APPLICATIONS

| | | | |
|---|---|---|---|
| 548,097 | 10/1922 | France | 403/379 |
| 18,094 | 9/1928 | Netherlands | 61/53 |
| 1,121,111 | 7/1968 | United Kingdom | 61/53 |

*Primary Examiner*—Jacob Shapiro
*Attorney, Agent, or Firm*—John M. Montstream

[57] ABSTRACT

A pile joiner is disclosed for connecting together the ends of concrete piles which joiner includes a socket member and a mating member one of which is on the end of one pile and the other is on the end of the pile to be connected therewith. Each of these two members has a base plate with a central hole therethrough and a tubular element secured to each base plate and extending at right angles thereto. One tubular element is a socket element and the other is a mating element which is received within the socket element. The socket element and the mating element have at least a first sleeve means which includes a sleeve hole or holes through a wall or walls of each element and in alignment when the members are assembled together, an outer sleeve for each sleeve hole of the socket element extending outwardly and an inner sleeve for the sleeve hole or holes of the mating element extending inwardly or between sleeve holes in opposite walls thereof. When the two members are assembled together with their base plates in contact, the first sleeve means of each member or element are in alignment and receive a lock bar to retain the two members and their piles together against separation. Preferably the tubular socket element and the tubular mating element have a second sleeve means similar to the first which are in alignment when the two members are assembled together and preferably angularly located with respect to the first sleeve means. A second lock bar is received therein to additionally secure the two members and the ends of the piles together. The pile joiner is constructed so that it is suitable for piles of different forms in cross section and for a wide range of sizes of piles. The invention includes each member individually as well as the members in combination as a pile joiner.

25 Claims, 4 Drawing Figures

PILE JOINER FOR CONNECTING THE ENDS OF CONCRETE PILES AND ITS MEMBERS

Concrete piles are manufactured in various manageable lengths, however, if longer piles are needed than the lengths provided, the ends of two or more piles are joined together with the pile joiner. This pile joiner includes a socket member secured to the end of one pile and a mating member is secured to the end of the pile to be connected therewith which members nest and are locked together to secure the ends of the two piles together against separation. Each member is molded to the concrete when it is poured in the making of the pile. The two members must be rugged in order to withstand the abuse and stress necessarily involved in the assembling of the ends of the two piles and in order to provide a connection that is as strong and secure as the piles themselves and a joiner which is easy to assemble.

An object of the invention is to construct a pile joiner for more effectively and securely joining together the ends of two or more concrete piles.

Another object is to construct a pile joiner using a socket member secured to the end of one pile and a mating member secured to the end of a second pile in which member has a tubular element which nest together and the two elements have at least one sleeve means extending at right angles thereto and in alignment to receive a lock bar which locks the two members together in assembled relation and retains the ends of the piles against separation.

A further object is to construct a pile joiner as above in which at least a second sleeve means is carried by the two elements at right angles thereto and in alignment so as to receive a second lock bar.

Another object is to construct a pile joiner which is suitable for use with concrete piles of any cross sectional form.

Again the pile joiner is one which is suitable for concrete piles over a wide range of cross dimensions of piles.

Other objects of the invention will be more apparent from the following description when taken in connection with the accompanying drawing illustrating preferred embodiments thereof in which.

Figure 1:
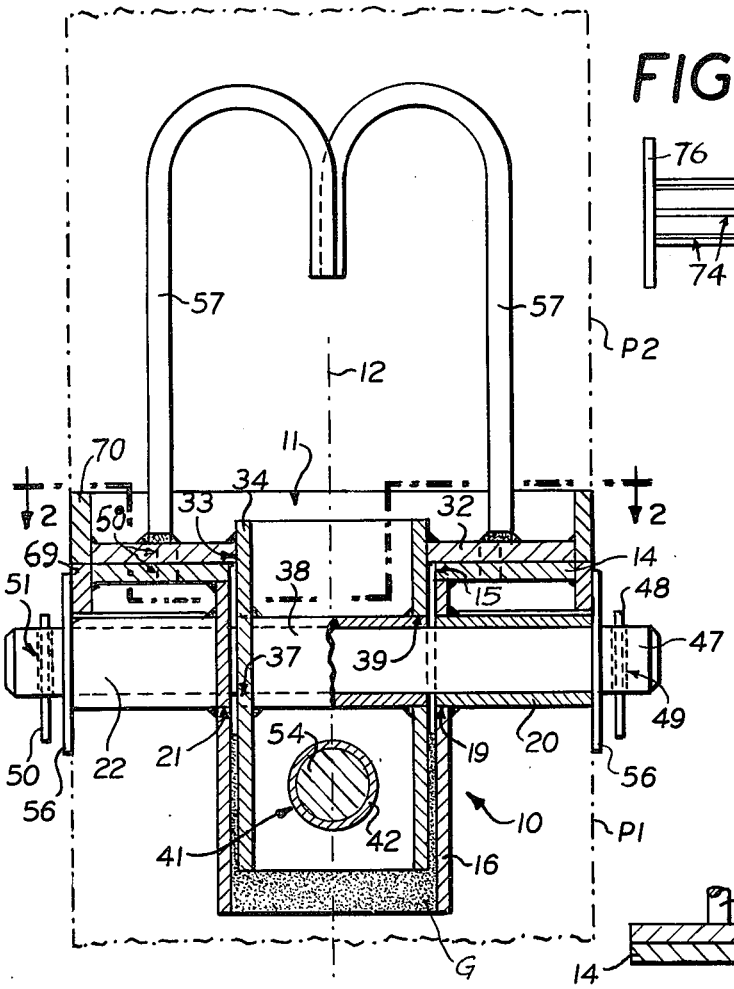
FIG. 1 is a section of the pile joiner taken on line 1—1 of FIG. 2.

The pile joiner comprises two members including a socket member 10 which is molded to one end of a concrete pile when it is molded or poured and a mating member 11 which is molded to the end of a second pile if the pile is to be a two unit construction, or is molded to the first pile if the pile is to be a multi-unit pile of three or more units. These two members fit or nest together when two or more pile units are joined end to end to secure the ends of the piles together. Any number of such pile units or sections can be assembled together. The upper end and the lower end of a two unit pile or a multi-unit pile do not need a member although one could be provided if desired at the top of the combined pile as a cap to resist chipping or breaking of this end of the pile or to provide a base plate for any structure to be supported by the pile. The concrete pile units may be constructed at the concrete plant and trucked to the construction site where the pile units are assembled together. The piles need not be made or poured at the construction site. The pile joiner is constructed to fit the cross dimension of the pile as well as its cross section which may be square, octogonal, round, hexogonal, rectangular, etc. The base plates should be dimensioned and shaped to conform with the pile size and shape, for example, for a 14 inch square pile the joiner has a square base plate with 14 inch sides. The pile joiner and the members have a central axis 12.

The socket member 10 includes a socket base plate 14 having a central hole 15 therethrough. The base plate in the form shown is of a dimension and shape conforming with the pile, that shown being square with opposite edges. A tubular socket element 16 is secured to the base plate, such as by welding, extending at right angles to the base plate and in alignment with the hole 15. The tubular socket element has an inner dimension as will appear and is shown as square in cross section although it could be round, octagonal and other forms. The cross sectional shape of the base plate hole 15 is the same as that of the socket element and the cross dimension is shown as the same as the inner dimension of the socket element although it could be the same as the outer dimension so as to receive the same. The length of the socket element may be selected as desired.

The tubular socket element 16 has at least a first sleeve means including a sleeve hole 19 through a wall thereof in which an outer sleeve 20 has its inner end secured to the element. The sleeve extends outwardly therefrom with its outer end in alignment with the edge of the base plate or pile surface and at right angles to the socket element. This sleeve need not be secured within the hole in which event the sleeve hole has a dimension the same as the inner dimension of the sleeve and the sleeve is in alignment therewith. Preferably the first sleeve means has a second sleeve hole 21 provided through the opposite wall of the tubular socket element which hole is in alignment with the sleeve hole 19. An outer sleeve 22 has its inner end similarly secured within or at this sleeve hole so that the two outer sleeves 20 and 22 are in alignment with each other and extend outwardly solely from its wall of the socket element: that is no part of the sleeve extends into the central part of the socket element.

Figure 2:
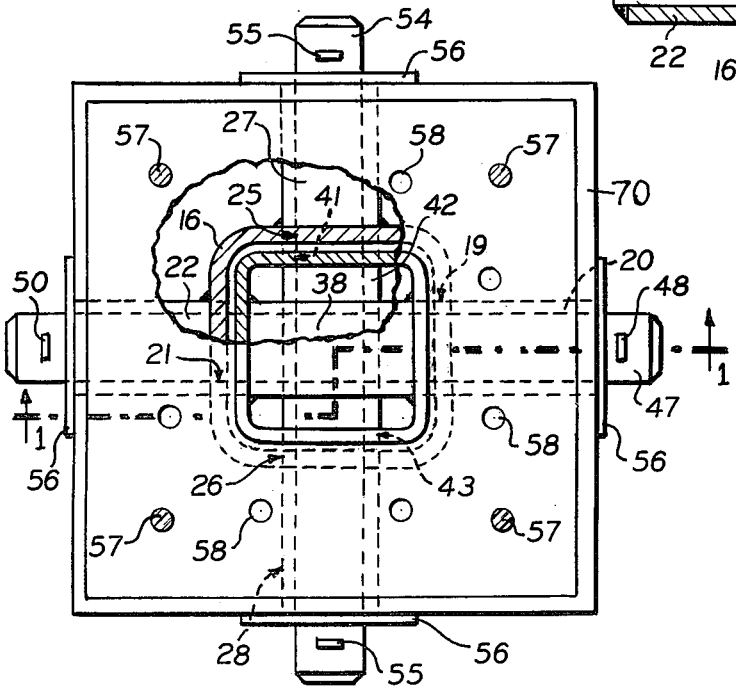
FIG. 2 is a top view of FIG. 1 with a part in section as taken on line 2—2 of FIG. 1.

For greater strength a second sleeve means may be provided including aligned sleeve holes 25, 26 through opposite walls of the socket element 16 with the inner end of an outer sleeve 27 secured in or at the sleeve hole 25 and the inner end of an outer sleeve 28 is secured at or in the sleeve hole 26. The second sleeve means is preferably spaced longitudinally from the first sleeve means or angularly with respect to the first sleeve means or both as illustrated in FIGS. 1 and 2. The sleeves of the second sleeve means extend solely outwardly.

The pile joiner includes the mating member 11 having a base plate 32 with a central hole 33 therethrough in or at which is secured a tubular mating element extending at right angles to its base plate. The base plate is shown as square and has opposite edges. The mating element is shown as extending through the central opening in the base plate which assures a firmer attachment of the element thereto. The mating element has an outer cross dimension and a cross sectional form such that it is received within the tubular socket element 16, hence desirably of the same form. The maximum length of the tubular mating element projecting beyond its base plate 32 may be such that its end is in alignment with the end of the socket element when the two members are assembled together with their base plates in contact in which event the mating element is longer than the socket element by the thickness of the socket base plate. Preferably the mating element is shorter than this.

The tubular mating element 34 carries at least a first sleeve means comprising at least one sleeve hole 37 in a wall of the element in which, or at which, is secured the outer end of a sleeve 38 which is directed inwardly solely, that is no part of the same projects outwardly from the element. Preferably, the opposite wall of the tubular mating element has a sleeve hole 39 therethrough in alignment with the sleeve hole 37 and the sleeve is long enough to extend between the holes and the other end of this sleeve is secured in or at this hole so that both ends are secured. The sleeve 38 is located longitudinally from its base plate 32 a distance such that it is in cooperative alignment with the first sleeve means 20, 22 for the tubular socket element 16 when the members are assembled together.

If the socket element carries a second sleeve means, then the mating element is provided with a second sleeve means for cooperation therewith. The second sleeve means for the mating element includes a sleeve hole 41 in one wall of the element in or at which is secured a sleeve 42. Preferably the other or opposite wall of the mating element has a sleeve hole 43 in or at which the other end of the sleeve 42 is secured. The sleeve of this second sleeve means is in cooperative longitudinal and angular alignment with the sleeves 27 and 28 of the second sleeve means carried by the socket element when the two members are assembled together. The second sleeve means for the mating element is spaced then from its base plate 32 a distance equal to the spacing of the second sleeve means for the socket element plus the thickness of the base plate 14 of the socket member.

With the socket member 10 molded into the end of its concrete pile P1, the concrete flows around the sleeve means so that the member is firmly anchored or secured to the end of its pile. Similarly the mating member is molded into the end of the pile P2 with the concrete flowing into the inner area of the tubular element 34 and around and embedding the sleeve means therein to firmly anchor or secure the mating member to the end of its pile, or the other end of the same pile.

When the two members on the end of their respective piles are assembled or nested together such that the cooperating first and second sleeve means are in alignment, a lock bar 47 is projected through the first sleeve means of both elements and a securing pin 48, such as a cotter pin, is inserted and fixed in a pin hole 49 at one end of the bar and a similar securing pin is inserted in a pin hole 51 in the other end of the locking bar which pins retain the lock bar within the sleeve means. If a second sleeve means has been provided, a like lock bar 54 is inserted there-through which bar may be similarly retained therein by securing cotter pins 55. An end washer 56 may be received on the end of each outer sleeve means and retained thereon by the cotter pin.

If a firmer anchorage is desired between the mating member 11 and the concrete of the pile, anchorage means may be provided in the form of a plurality of reinforcing rods 57 which are secured to the base plate 32 and preferably their outer ends are bent or hooked inwardly. These rods extend from the base plate in a direction oppositely to that of the tubular mating element 34. If the pile is to be prestressed then the base plate may be provided with wire holes 58 to receive prestressing wires (not shown) with the ends of the wires secured therein. The holes 58 are located circularly which makes them suitable for piles such as round, octagonal smaller square and other cross sectional shapes of piles.

If desired additional sleeve means and lock bars may be provided which would be uniformly angularly located. With the two sleeve means illustrated, the sleeve means are preferably located 90 degrees apart.

Figure 3:
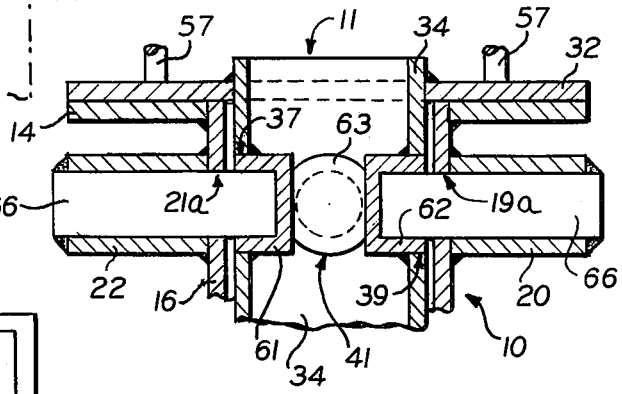
FIG. 3 is a partial sectional view showing a modified construction of the pile joiner; and, FIG. 4 shows an alternate form of lock bar which is received in the sleeve means.

A modified form of pile joiner is illustrated in FIG. 3 with similar parts bearing the same numerals. This construction illustrates that the sleeves 20 and 22 for the first sleeve means of the socket element 16 need not be secured to said element by being inserted in its respective sleeve hole **19*a* and 21*a*** and welded therein although the sleeve is in alignment therewith. The second sleeve means need not be longitudinally or axially spaced from the first sleeve means in the event that a shorter pile joiner should be required. With two sleeve means being in the same plane, the second sleeve means must, however, be spaced angularly from the first sleeve means.

The mating member 11 for its first sleeve means receives a closed end sleeve 61 in its sleeve hole 37 and a closed sleeve 62 in its sleeve hole 39. As stated above, the socket element has a second sleeve means angularly located 90 degrees from the first sleeve means so that the mating element is provided with a second sleeve means at right angles to the first sleeve means and includes a closed end sleeve 63 received in its sleeve hole 41a. A similar closed end sleeve is secured at its sleeve hole in the opposite wall of the tubular mating element 34. (not shown).

The two members of the pile joiner of FIG. 3 are retained together by a lock bar 66 for each sleeve means which is projected through the outer sleeve of the socket element and into its cooperating inner sleeve of the mating element. Since the inner end of each lock bar is not accessible for a securing pin, the lock bar is secured within the sleeve means by welding the bar to the end of the outer sleeve after the two members with their piles have been assembled together. It is clear that one of the sleeve means for the mating element may have a sleeve, such as the sleeve 38, extending between opposite sleeve holes in which construction a lock bar 47 may be used. Also with this form of sleeve means for the mating element with a closed end, an odd number of sleeve means such as three or five may be used if desired which are uniformly spaced angularly from each other.

Either base plate 14 or 32 but preferably both plates may be provided with a skirt 69 and 70 respectively around the edge or edges of the base plate for better protection of the sides and ends of the piles. The concrete surface may correspond with the outer surfaces of the skirt as shown rather than with the inner surfaces thereof. The skirt is formed in any suitable fashion and secured to the base plate and forming a part thereof.

Figure 4:
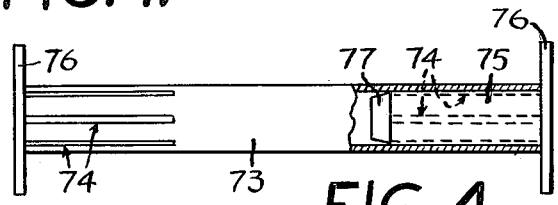

An alternate form of lock bar which is received through or in the sleeve means is shown in FIG. 4. This bar is a tube 73 corresponding in length with the sleeve means. Each end of the bar is expandable, such as by a suitable number of slits 74 extending from each end thereof, six being shown. The slits are long enough so that a length of pipe or bar when expanded provides at least a good grip with the sleeve means. A length of slit approximating the length of the outer sleeve is deemed to provide an ample grip. A plug 75 having a diameter greater than the inner dimension of the locking bar tube or pipe 73 and enough greater to provide a drive fit for the plug with the tube expanded will secure this locking bar in place. The plug may have a disk 76 on the outer end thereof to provide a stop. With this form of lock bar, the bar projects beyond the surface of the pile only by the thickness of the disk. The plug has a taper at its inner end to provide an expanding surface for the lock bar on the plug. This form of lock bar is suitable in place of the lock bars 66 in the construction of FIG. 3 in which the outer end solely is expandable and receives the expanding plug 75.

The various parts of the pile joiner may be secured together in any suitable manner, however, welding is a convenient and simple method for accomplishing this. The tubular elements 16 and 34 are illustrated as being square in cross section, however, they may be of any cross sectional form including round. The square cross sectional form is more advantageous than the round because it is easy and positive to align the sleeve means and also, a flat surface is presented to the end of the sleeves so that the sleeve ends may be flat. With round tubular elements the inner ends of the outer sleeves and the outer ends of the inner sleeves must be shaped to conform with a cylindrical surface. Similarly the sleeves may be of any cross sectional form, however, cylindrical sleeves are a common and convenient form.

The pile joiner in the more common sizes would be from 10 inches to 24 inches varying in size by two inches. The construction of the pile joiner is the same for piles of any cross dimension, usually however, concrete piles do not exceed 60 inches. It is essential that the outer sleeves carried by the socket element extend to the outer dimension or surface of the pile so that the outer end of these sleeves are at least level with the surface of the pile. The length of the outer sleeves, therefor, depends on the cross dimension of the pile and the cross dimension of the socket element. The lock bar also has a length depending upon the length of the outer sleeves or the dimension between the outer ends of the sleeves in the construction of FIGS. 1, 2 and 4. This corresponds with the cross dimension of the pile. For the construction of FIG. 3, the length of the lock bar is at least equal to the dimension from the closed end of the inner sleeve 61 or 62 of the mating element to the outer end of the outer sleeve or to the surface of the pile.

In assembling the ends of the two piles, grouting G is poured into the socket element which fills the clearance space at the bottom of the socket element and a substantial part of the clearance space between elements. The grouting hardens to prevent sidewise movement between the two elements and members.

This invention fills a need for improvements in a pile joiner and pile joiner members for concrete piles. Various modifications thereof may and often do occur to those skilled in the art, especially after benefitting from the teachings herein. The preferred means of embodying the invention in useful form is disclosed.

What is claimed is:

1. A pile joining member forming a socket member or a mating member for a pile joiner for connecting together the ends of two concrete piles and each member having a tubular element comprising a base plate having a center and a hole therethrough at the center thereof, a tubular element having a cross dimension less than that of the base plate and secured to the base plate centrally thereof and extending at right angles thereto, the tubular element having ends and a cross dimension the same as or approximately the same as that of the hole in the base plate and having opposite walls, the tubular element having a cross dimension and form so as to receive the tubular element of the other member, and the wall of the tubular element having at least a first sleeve means including at least one sleeve hole through a wall thereof and a straight sleeve, said sleeve hole having a dimension and spaced from the base plate and between the ends of the element, said sleeve being secured to at least one wall of the tubular element at a sleeve hole and extending in one direction either outwardly or inwardly from the wall and at right angles thereto, and said sleeve having an outer cross dimension and an inner cross dimension one of which is the same as the dimension of the sleeve hole.

2. A pile joining member as in claim 1 in which the sleeve means includes a first pair of sleeve holes through opposite walls of the tubular element and in alignment.

3. A pile joining member as in claim 2 including a second sleeve means carried by the tubular element having a second pair of aligned holes through opposite walls of the tubular element and angularly spaced with respect to the first sleeve means.

4. A pile joining member as in claim 2 including a second sleeve means carried by the tubular element having a second pair of aligned sleeve holes through opposite walls of the tubular element and longitudinally spaced from the first sleeve means.

5. A pile joining member as in claim 3 in which the second sleeve means is spaced longitudinally from the first sleeve means.

6. A pile joining member as in claim 1 in which the tubular element is a socket element having an inner cross dimension and form to receive the tubular element of the mating member, each sleeve having an inner end and an outer end with the inner end secured to the tubular element and the sleeve extending outwardly solely therefrom, and each sleeve having a length such that the outer end thereof is in or roughly in alignment with an adjacent edge of the base plate.

7. A pile joining member as in claim 6 in which the tubular element has at least a first pair of sleeve holes therethrough opposite to each other and in alignment for a pair of sleeves.

8. A pile joining member as in claim 7 in which the tubular member has a second pair of sleeve holes through opposite sides thereof and in alignment for a second pair of outer sleeves, and the second pair of holes and outer sleeves being spaced longitudinally from the first pair of sleeve holes and from the base plate and angularly spaced from the first sleeve means.

9. A pile joining member as in claim 1 in which the tubular element is a mating element having a cross dimension and form to be received within the socket tubular element of the socket member, the mating tubular element having a length equal to or less than the length of the socket tubular element, and in which the sleeve of the sleeve means is secured within the tubular element to at least one wall thereof at a sleeve hole, and the first sleeve means being located with respect to its base plate so as to be in cooperative alignment with the first sleeve means of the socket tubular element when the members are assembled together.

10. A pile joining member as in claim 9 in which the sleeve means includes a pair of aligned sleeve holes through opposite walls of the mating tubular element, and the sleeve extending inwardly solely between the walls of the mating tubular element and each end of the sleeve being secured to a wall of said element at a sleeve hole.

11. A pile joining member as in claim 9 including a second sleeve means having at least one sleeve hole through the wall of the mating tubular element spaced angularly with respect to the first sleeve means and longitudinally from its base plate, and a sleeve secured to the mating tubular element at least at one sleeve hole and extending inwardly within said element and located with respect to its base plate so as to be in cooperative alignment with the second sleeve means of the socket tubular element when assembled together.

12. A pile joining member as in claim 11 in which the second sleeve means is spaced longitudinally from the first sleeve means.

13. A pile joining member as in claim 10 including a second sleeve means having a second pair of aligned sleeve holes through opposite walls of the mating tubular element and spaced longitudinally and angularly with respect to the first sleeve means and located so as to be in cooperative alignment with a second sleeve means carried by the socket tubular element when the members are assembled together.

14. A pile joining member as in claim 9 including at least one anchor rod secured to the base plate and extending therefrom in a direction oppositely to that of the mating tubular element.

15. A pile joiner for connecting the ends of concrete piles having an outer surface comprising in combination a socket member having a central axis including a socket base plate having a center axis and a center hole therethrough, the socket base plate having edges and a cross dimension from edge to edge thereof, a tubular socket element of smaller cross dimension than that of the socket base plate secured to said base plate centrally thereof and extending in one direction therefrom, said socket element extending at right angles to its base plate, and having an inner dimension the same as or approximately the same as that of the hole in the base plate, the tubular socket element having at least one sleeve means, each sleeve means including a sleeve hole through a wall thereof and between the ends thereof and spaced from its base plate, an outer sleeve for each sleeve hole having an inner end and an outer end with the inner end being secured to the tubular socket element at the sleeve hole, the outer sleeve extending solely outwardly from and at right angles to the socket element and having a length to reach the surface of the pile to be made; a mating member including a mating member base plate having a hole therethrough at the center thereof, a tubular mating element secured to the mating member base plate centrally thereof and extending at right angles to its base plate, said mating element having a cross dimension and form so as to be received within the tubular socket element, the tubular mating element having at least a first sleeve means, each sleeve means including a sleeve hole through the wall of the mating element and in cooperative alignment with the sleeve means in the socket element when the two members are assembled together with their base plates in contact, and an inner sleeve secured within the mating element in alignment with its sleeve hole, and the outer sleeve of the socket element and the inner sleeve of the mating element having the same cross dimension.

16. A pile joiner as in claim 15 including a lock bar having ends and a cross dimension and form to be received in the sleeves of the socket element and the mating element and of a length to locate an end of the lock bar at least at the outer end of the outer sleeve.

17. A pile joiner as in claim 15 in which the sleeve holes in the tubular socket element and the tubular mating element includes at least a first pair of sleeve holes opposite to and in alignment with each other.

18. A pile joiner as in claim 17 including at least a second pair of sleeve holes through the tubular socket element and the tubular mating element and in cooperative alignment with each other when the socket member and the mating member are assembled together, the second pair of sleeve holes being longitudinally spaced from their base plates and angularly spaced from the first pair of sleeve holes.

19. A pile joiner as in claim 17 including at least a second pair of sleeve holes through the tubular socket element and the tubular mating element and in cooperative alignment with each other when the socket member and the mating member are assembled together, the second pair of sleeve holes being longitudinally spaced from their base plates and from the first pair of sleeve holes.

20. A pile joiner as in claim 18 in which the second sleeve means is longitudinally spaced from the first sleeve means.

21. A pile joiner as in claim 15 in which the tubular socket element and the tubular mating element are square.

22. A pile joiner as in claim 17 including a lock bar of a dimension and form to be received in the sleeves of the socket element and the mating element, the lock bar having a length greater than the dimension between the outer ends of the pair of outer sleeves of the socket element, and securing means carried by each end of the lock bar to retain the same within the sleeves.

23. A pile joiner as in claim 15 including anchorage means secured to the base plate of the mating member and projecting in a direction opposite to the direction of the tubular mating element.

24. A pile joiner as in claim 16 in which the lock bar includes at least one expandable end, and an expanding plug received with a drive fit in the at least one expandable end of the lock bar.

25. A pile joiner as in claim 24 in which the lock bar is tubular having ends and each end is slitted to make the same expandable, and an expanding plug for each end.

* * * * *